US006561281B1

(12) United States Patent
Arnold

(10) Patent No.: US 6,561,281 B1
(45) Date of Patent: May 13, 2003

(54) FLUENT MATERIAL DISPENSING APPARATUS AND METHOD OF USE

(76) Inventor: Patrick D. Arnold, 4096 Horizon La., Suite C, San Luis Obispo, CA (US) 93401

( * ) Notice: Subject to any disclaimer, the term of this patent is extended or adjusted under 35 U.S.C. 154(b) by 0 days.

(21) Appl. No.: 09/417,198

(22) Filed: Oct. 9, 1999

(51) Int. Cl.[7] ..... A62C 2/00; A62C 8/00; A62C 31/32

(52) U.S. Cl. ..... 169/46; 169/43; 169/47; 169/50; 239/276

(58) Field of Search ..... 169/43, 46, 47, 169/50, 62, 67, 68, 70, 74, 35, 30; 222/80, 191; 239/271, 337, 154, 375, 276

(56) References Cited

U.S. PATENT DOCUMENTS

| | | | | | |
|---|---|---|---|---|---|
| 1,106,679 | A | | 8/1914 | Randall | |
| 1,464,001 | A | * | 8/1923 | Idding | 169/68 |
| 2,235,915 | A | | 3/1941 | Bohan | |
| 2,413,083 | A | * | 12/1946 | Snowden et al. | 169/67 |
| 2,732,017 | A | * | 1/1956 | Fleming | 169/67 |
| 2,756,829 | A | | 7/1956 | Phillips | |
| 3,530,941 | A | * | 9/1970 | Hansen et al. | 169/30 |
| 4,106,701 | A | * | 8/1978 | Siefken | 239/271 |
| 4,219,084 | A | | 8/1980 | Gray et al. | |
| 4,625,808 | A | * | 12/1986 | Halfpenny | 169/30 |
| 4,676,319 | A | | 6/1987 | Cuthbertson | |
| 4,802,535 | A | | 2/1989 | Bakke | |
| 4,970,823 | A | * | 11/1990 | Chen et al. | 239/276 |
| 5,062,486 | A | | 11/1991 | McClenahan | |
| 5,172,515 | A | * | 12/1992 | Lapshansky, Sr. et al. | 47/48.5 |
| 5,368,106 | A | | 11/1994 | Coughlin | |
| 5,409,067 | A | | 4/1995 | Esposito et al. | |
| D364,488 | S | * | 11/1995 | Nasin | 169/30 |
| 5,540,284 | A | | 7/1996 | Espostio et al. | |
| 5,577,561 | A | | 11/1996 | Cook | |

* cited by examiner

*Primary Examiner*—Michael Mar
*Assistant Examiner*—Davis Hun
(74) *Attorney, Agent, or Firm*—Leo F. Costello

(57) ABSTRACT

A portable apparatus and method for dispensing fire retardant or other materials into relatively inaccessible areas. The apparatus and method are particularly suited for releasing an extinguishing agent on a fire that is burning under the hood of a vehicle or behind a wall or other barrier separating the fire from the firefighter or for dispensing other materials in like situations. The apparatus includes a tank and a nozzle rigidly attached to the tank. The attachment may be either separable by securing the nozzle to a jacket that fits around the tank, or integral by welding the nozzle to the tank. The tank, which conveniently may be the tank of a standard portable fire extinguisher, contains a fluent fire retardant, or other fluent material, and has an outlet through which the material can be dispensed. The nozzle extends from the tank and provides a penetrating end, a fluid-conducting passageway having an outlet opening through the penetrating end, and an inlet connected to the outlet of the tank. In use, the nozzle is manually thrust through the sheet metal of the vehicle's hood, or other barrier, using the weight of the tank to penetrate the barrier with the nozzle and position its outlet in the region of the fire, or other inaccessible area, whereupon a valve on the tank is opened to release fire retardant onto the fire or to dispense the other material into the area.

36 Claims, 8 Drawing Sheets

FLUENT MATERIAL DISPENSING APPARATUS AND METHOD OF USE

BACKGROUND

Extinguishing an automobile engine fire can be a very difficult and nerve-wracking task. Difficult because the fire may be burning under the closed and latched hood of the vehicle so spraying water or other fire retardant on the surface of the vehicle is ineffective to douse the flames. Nerve-wracking because of the financial loss and the possibility of imminent explosion if the burning is allowed to continue. Moreover, such fires often occur because of engine overheating while the vehicle is being driven on a busy thoroughfare, such as a freeway. The motorist is forced to pull over to the side of the highway in a dangerous location, is usually helpless to extinguish the fire, and must nervously await the arrival of the fire truck.

Upon arrival at the scene, the fire personnel must first gain access to the area under the hood before the fire can be controlled. Since the hood is usually down and latched, the fire makes manually releasing the latch very difficult and perhaps impossible. In the past, therefore, the firefighter has used an ax to chop an opening in the hood through which the nozzle of a fire hose can then be inserted and retardant released. This multi-step operation naturally delays the end objective of spaying fire retardant on the blaze, further exposing the firefighter and others to danger and allowing the fire to continue its damage.

Certain of the above described problems are experienced in fighting fires in inaccessible areas other than under the hood of a vehicle. Some of these problems exist when fires occur within the passenger compartment of a locked vehicle or a locked trunk; in a locked mobile home or truck trailer; in an aircraft; and even more commonly in a building where a fire is burning between walls of the building. Several patents disclose equipment for smothering a fire in such inaccessible areas. However, none of the known devices is sufficiently compact, portable and self-contained to make it ideal for extinguishing a serious but small fire burning in an automobile engine under the closed hood of the vehicle.

SUMMARY

A portable apparatus and method for dispensing fire retardant or other materials into relatively inaccessible areas are provided. The apparatus and method are particularly suited for releasing an extinguishing agent on a fire that is burning under the hood of a vehicle or behind a wall or other barrier separating the fire from the firefighter or for dispensing other materials into other inaccessible areas. The apparatus includes a tank and a nozzle rigidly attached to the tank. The attachment may be either separable by securing the nozzle to a jacket that fits around the tank, or integral by welding the nozzle to the tank. The tank, which conveniently may be the tank of a standard portable fire extinguisher that contains a fluent fire retardant, or another tank containing another fluent material, and has an outlet through which the material can be dispensed. The nozzle extends from the tank and provides a penetrating end, a fluid-conducting passageway having an outlet opening through the penetrating end, and an inlet connected to the outlet of the tank. In use to extinguish a fire, the nozzle is manually thrust through the sheet metal of the vehicle's hood, or other barrier, using the weight of the tank to penetrate the barrier with the nozzle and to place its outlet in the region of the fire, or other inaccessible area, whereupon a valve on the tank is opened to release fire retardant onto the fire or to dispense the other material into the area.

An object of the present invention is to provide a method and apparatus for dispensing fire retardant and other materials in relatively inaccessible areas.

Another object is provide a method and apparatus for extinguishing automobile fires.

A further object is to lessen the physical dangers and loss of property associated with fighting a vehicle fire.

An additional object is to provide a compact, portable and self-contained apparatus for fighting an engine fire burning under the closed hood of a vehicle.

Yet another object is to provide a method and apparatus that allows conventional portable fire-fighting equipment to be used to extinguish a serious but relatively small fire behind a barrier.

A still further object is to provide an apparatus that adapts a conventional portable fire extinguisher tank so that the tank can be used to assist in thrusting a retardant-emitting nozzle through a barrier behind which a fire is burning so that retardant may be sprayed onto the fire.

Yet an additional object is to provide a method and apparatus for extinguishing fires in relatively inaccessible areas that allows a conventional, portable, fire extinguisher to be quickly adapted for penetrating barriers, such as a vehicle hood, behind which a fire, such as an engine fire, is burning, but allows the fire extinguisher to be otherwise used in the usual manner for other types of fires.

A further object is to provide a holder for a conventional fire extinguisher that facilitates use of the extinguisher in many fire-fighting tasks.

Another object is to dispense fire retardant or other materials behind or underneath a barrier with a portable dispenser that can punch a hole in the barrier and simultaneously insert a dispensing nozzle on the opposite side of the barrier from the user.

A feature of the present invention is a fluid-conducting, barrier-penetrating nozzle attached to a fire extinguisher tank.

These and other objects, features and advantages of the present invention will become apparent upon reference to the following description, accompanying drawings, and appended claims.

DESCRIPTION OF THE DRAWINGS

7

DETAILED DESCRIPTION

Figure 1:
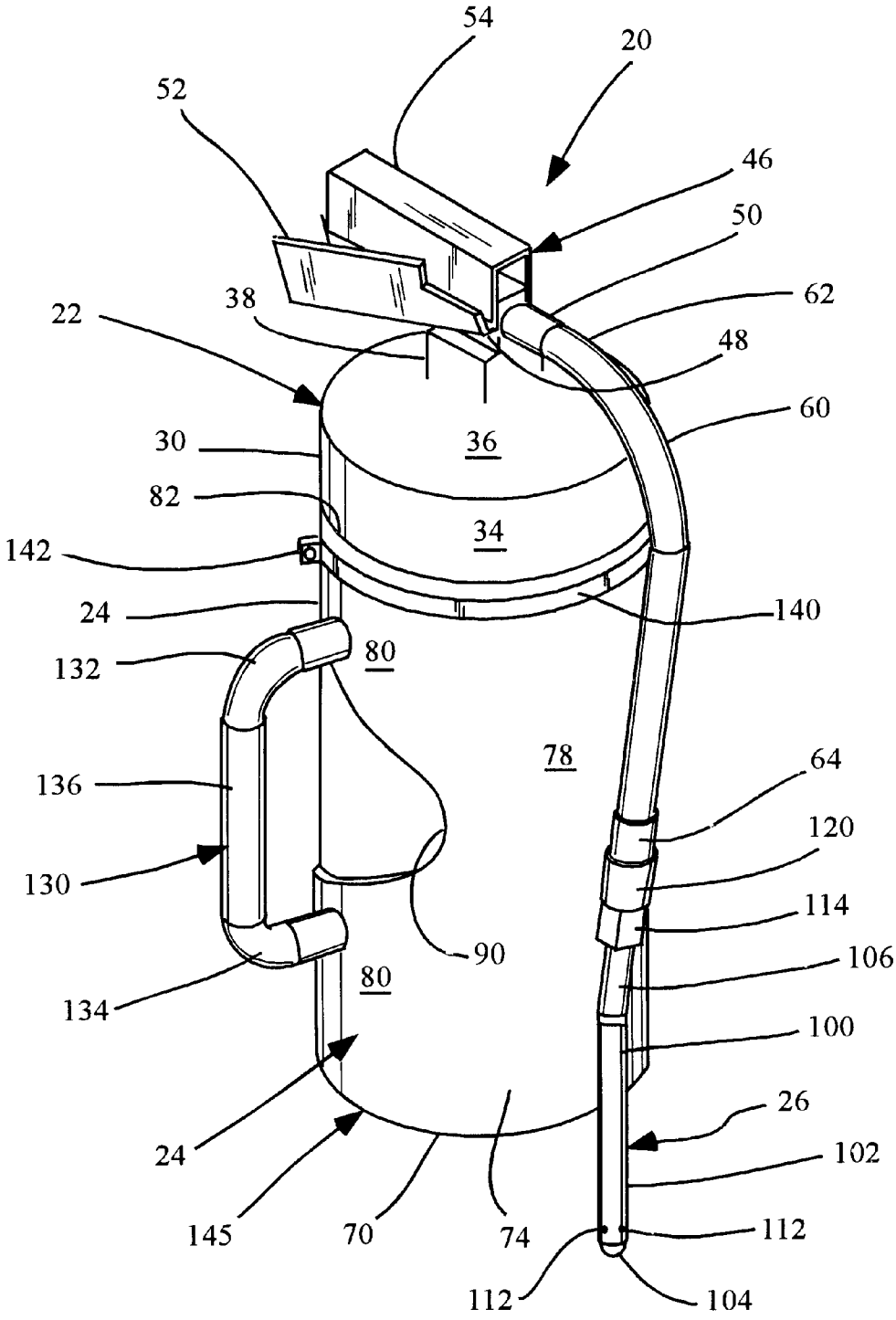
FIG. 1 is an isometric side elevation of one embodiment of a fire extinguishing apparatus in accordance with the principals of the present invention.

One embodiment of a portable fire extinguishing apparatus incorporating the principles of the present invention is generally indicated by the numeral 20 in FIGS. 1–4. In general, the apparatus of the first embodiment includes a fire extinguisher 22, a jacket 24, and a penetrating nozzle 26. Each of these elements of the apparatus and their relationship will now be described in more detail.

The fire extinguisher 22 (FIGS. 1–5) is a conventional portable fire extinguisher that may use various types of fire extinguishing agents. Although not so limited, one such conventional fire extinguisher that may be used with the present invention is made by Ansul Incorporated of Marinette, Wis., sold under the trademark ANSUL® SENTRY®, containing ten pounds of FORAY® multipurpose dry chemical extinguisher. Whether the fire extinguisher 22 is of the ANSUL brand, or of another brand, it includes a tank 30, having a circular bottom wall 32, a cylindrical side wall 34, a frusto-conical top wall 36, and a neck 38 terminating in a upper opening. By way of example and not limitation, and insofar as the ANSUL fire extinguisher is concerned, the side wall is approximately 5⅝" in diameter and approximately 14½" in length. Although similar dimensions as these are common for this conventional fire extinguisher, it is to be understood that the invention is not limited to any particular dimensions and that such dimension are given herein only by way of providing a specific example of one embodiment of the invention.

The conventional fire extinguisher 22 (FIGS. 1, 2 and 5) also includes a valve 46 having a fitting 48 that is threaded on the neck 38 of the tank 30 and an outlet 50. The valve also includes a stationary valve handle 52 and a pivotally moveable valve handle 54. A pressure gauge 56 is conventionally connected to the valve. A flexible hose 60 has an upper end 62 that is threaded into the outlet of the valve and a lower end 64.

Figure 12:
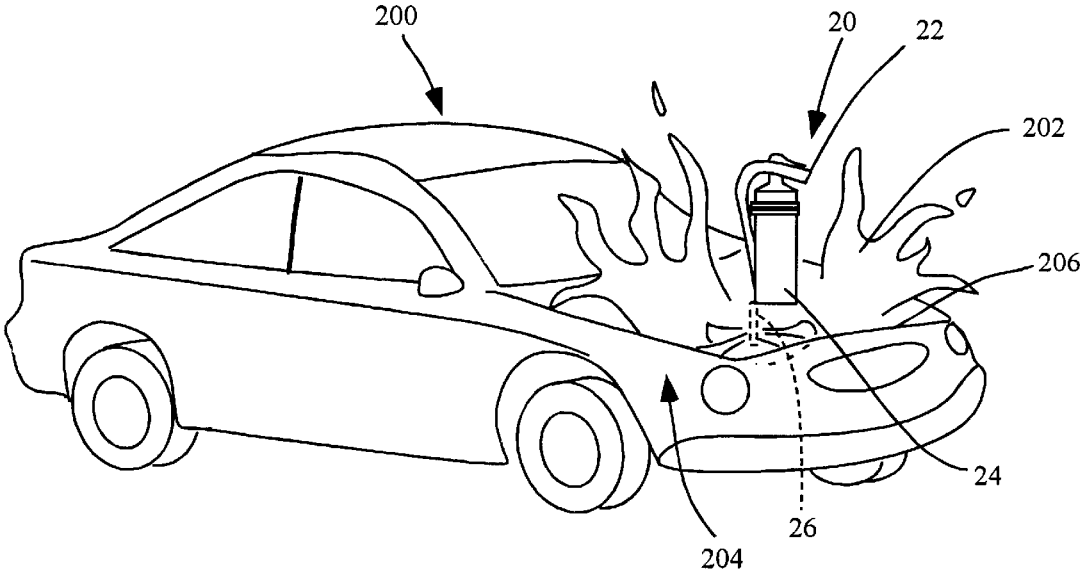
FIG. 12 is a side elevation of an automobile schematically indicating the existence of a fire burning under the closed hood of the vehicle and showing the fire extinguishing apparatus of the first embodiment of the present invention resting on the hood with the penetrating nozzle projected through the hood and spraying fire extinguishing material into the area of the fire.

The tank 30 is filled with a dry chemical fire extinguishing material or other fire extinguishing agent, not shown in FIGS. 1–4 but indicated as being ejected from the nozzle 26 in FIG. 12. When so filled with the extinguishing or fire retardant agent, the fire extinguisher weighs approximately 10 to 15 pounds. Again, the invention is not limited to this or any other particular weight, although the weight of the fire extinguisher does enhance the use of the apparatus, as will be described.

Figure 5:
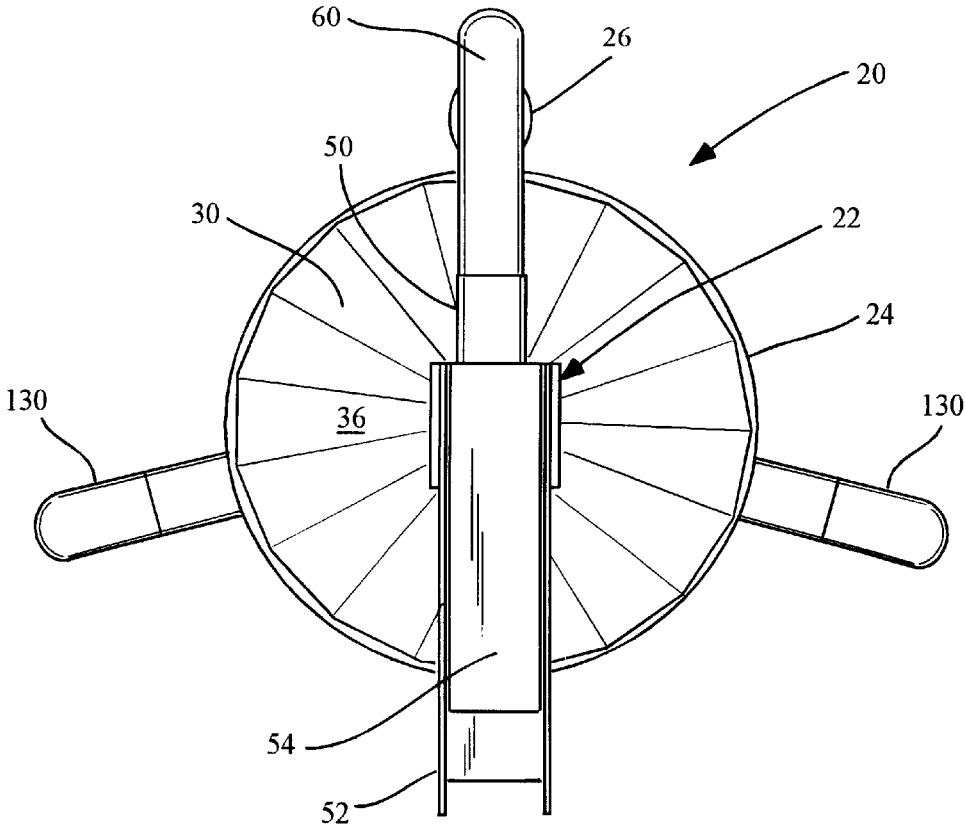
FIG. 5 is a somewhat enlarged, top plan view of the apparatus shown in FIGS. 1–4, as viewed when looking down on the apparatus from a position at the right of FIG. 3 or the front of FIG. 4.
Figure 6:
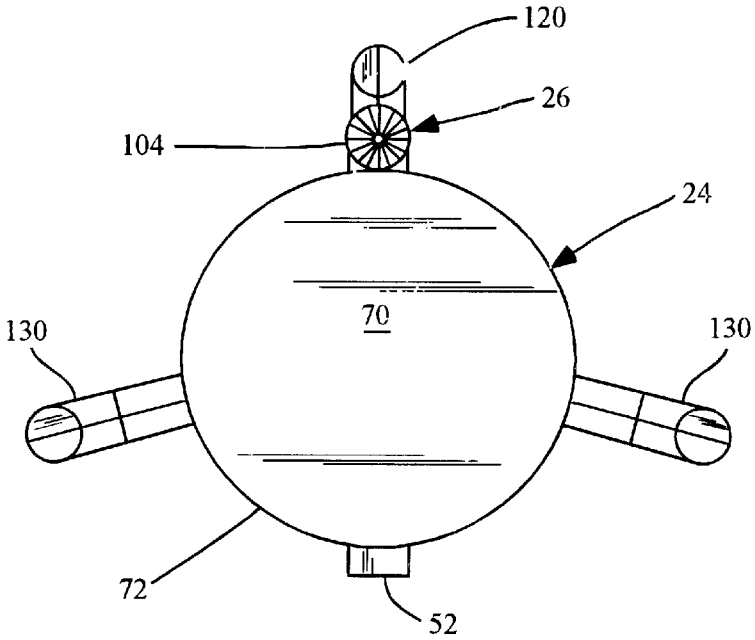
FIG. 6 is a somewhat reduced, bottom plan view of the embodiment of the apparatus shown in FIGS. 1–5.
Figure 7:
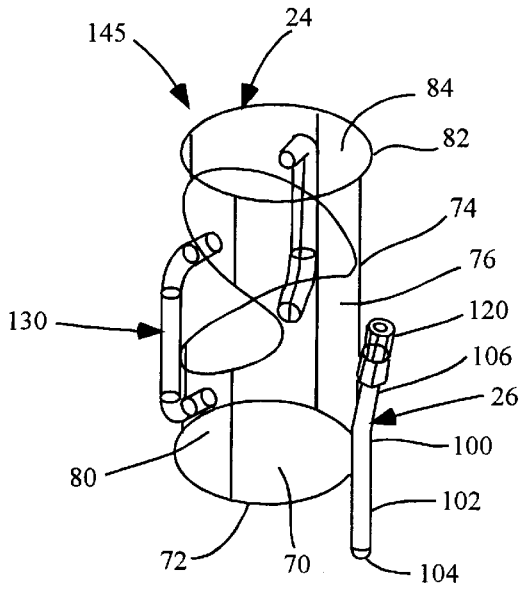
FIG. 7 is somewhat reduced, isometric computer-generated wire-frame view of the holder including the jacket, handles and penetrating nozzle of the apparatus shown in FIGS. 1–6 without the fire extinguishing tank fitted within the jacket, and since it is a wire-frame drawing showing interior features of the holder although such features would be normally hidden from view.
Figure 8:
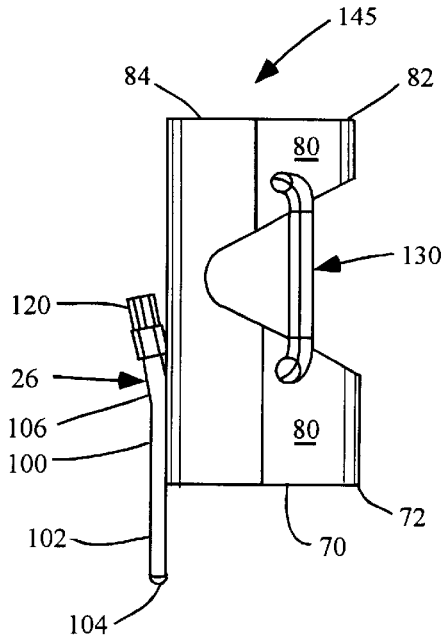
FIG. 8 is a side elevation of the holder as viewed from the right side of FIG. 7 and as viewed from the same angle as FIG. 3 although on a scale reduced from FIG. 3.
Figure 9:
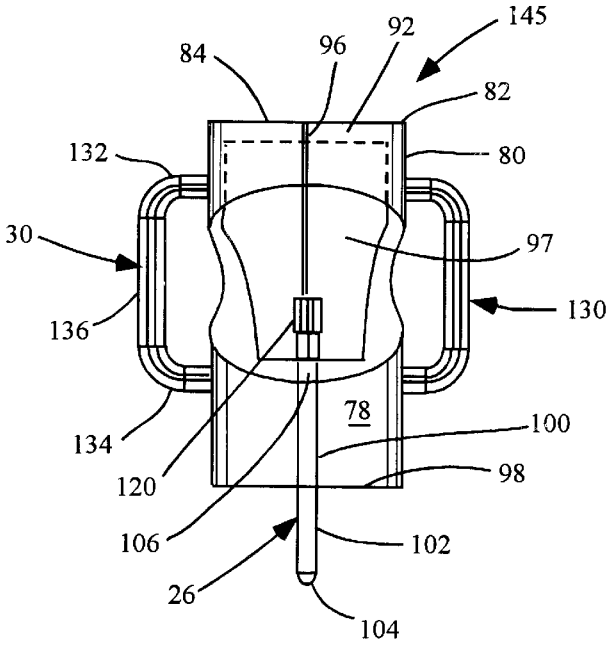
FIG. 9 is a computer-generated wire-frame view of a side elevation of the holder as viewed from the right of FIG. 8 and shown as transparent to see internal details.

The jacket 24 of the first embodiment of the fire extinguishing apparatus 20 is shown assembled with the fire extinguisher 22 in FIGS. 1–6 but is shown separated from the fire extinguisher in FIGS. 7–9, to which attention is now directed. This jacket may also be referred to as a container or a housing or simply as a mounting device for the fire extinguisher 22 and the penetrating nozzle 26. The jacket is of rigid construction, preferably metallic and preferably of 300 series stainless steel having a 0.87 inch thickness, although the invention is not limited to stainless steel and other rigid fire resistant materials may be employed. The jacket has a flat circular bottom wall 70 preferably providing a rim 72. A side wall 74 extends upwardly from the bottom wall along the generatrix of a cylinder. The side wall has a front surface 76, rear side 78, side surfaces 80, a top edge 82 terminating in an upper opening 84. As used with the specific fire extinguisher 22 made by the Ansel Corporation, the side wall has a length of approximately 12¼ inch measured from the bottom wall to the top edge of the side wall. Furthermore, the upper opening has a diameter of approximately 6 inches. Again, the invention is not limited to these particular dimensions, although it is to be noted that the diameter of the upper opening and thus the side wall must be large enough to accommodate a sliding fit of the tank 30. Furthermore, the length of the side wall is preferably slightly shorter than the length of the side wall 34 of the tank.

In order to reduce the weight of the jacket 24, the side wall 74 has a cut-away indicated at 90 (FIGS. 1, 2 and 5–8) at the rear and side surfaces 78 and 80. A T-shaped front insulating pad 97 is secured to the inside front surface of the jacket with upper portions of the pad extending partially around the upper mounting segment and with a lower portion extending downwardly into part of the lower mounting section of the jacket. Also, a bottom insulating pad 98 is adhered to the inside surface of the bottom wall 70 of the jacket 4. This cut-away divides the jacket into an upper section 92 and a lower section 94. The upper section is split at the rear surface 78 of the side wall thereby providing a gap 96. In contrast, the lower section is continuous circumferentially of the side wall.

The penetrating nozzle 26 (FIGS. 1, 2, and 5–8) is an elongated rigid tube that is securely fastened, as by welding, to the front surface 76 of the jacket 24. As thus seen in FIG. 7, the nozzle has an intermediate attaching portion 100 that is rigidly secured, as by welding, to the front surface of the jacket adjacent to the bottom wall 70. The nozzle also includes a penetrating end potion 102 projecting downwardly from the bottom wall 70 and the rim 72 in perpendicular relationship to the bottom wall. This penetrating end portion terminates in a sharp conical tip 104. In a preferred embodiment of the nozzle, the tip of the penetrating end portion is approximately 3¼" from the bottom wall, although the invention is not limited to this spacing. The nozzle also includes an upper coupling end portion 106 that is preferably slightly bent outwardly from the attaching portion so as to be in slightly spaced relation to the front surface 76 of the jacket.

The nozzle 26 (FIGS. 1, 2. and 5–8) includes an internal longitudinal fluid passageway extending from the coupling end portion 106 to the tip 104 of the penetrating end portion 102. The nozzle provides a plurality of outlet apertures 112 located circumferentially of the nozzle adjacent to the tip and communicating with the passageway. Furthermore, the coupling end portion terminates in an inlet 114. A quick-connect or other suitable coupling 120 includes a female part connected to the coupling end portion 106 in communication with the inlet 114 and a male part 19 connected to the lower end 64 of the hose 60.

Figure 2:
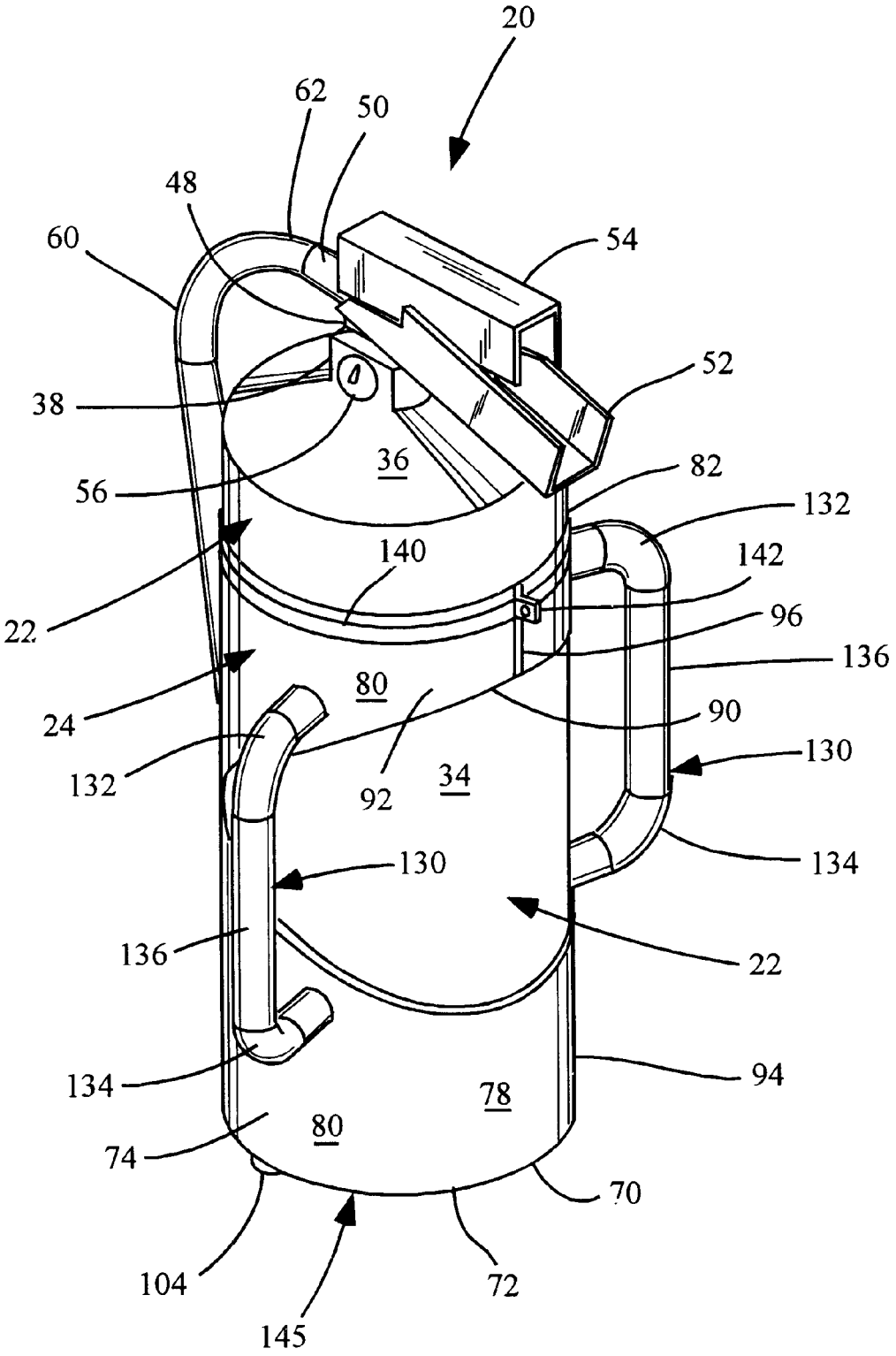
FIG. 2 is a somewhat enlarged, isometric side elevation of the fire extinguishing apparatus of FIG. 1 looking at the apparatus from a position at the left of FIG. 1.
Figure 3:
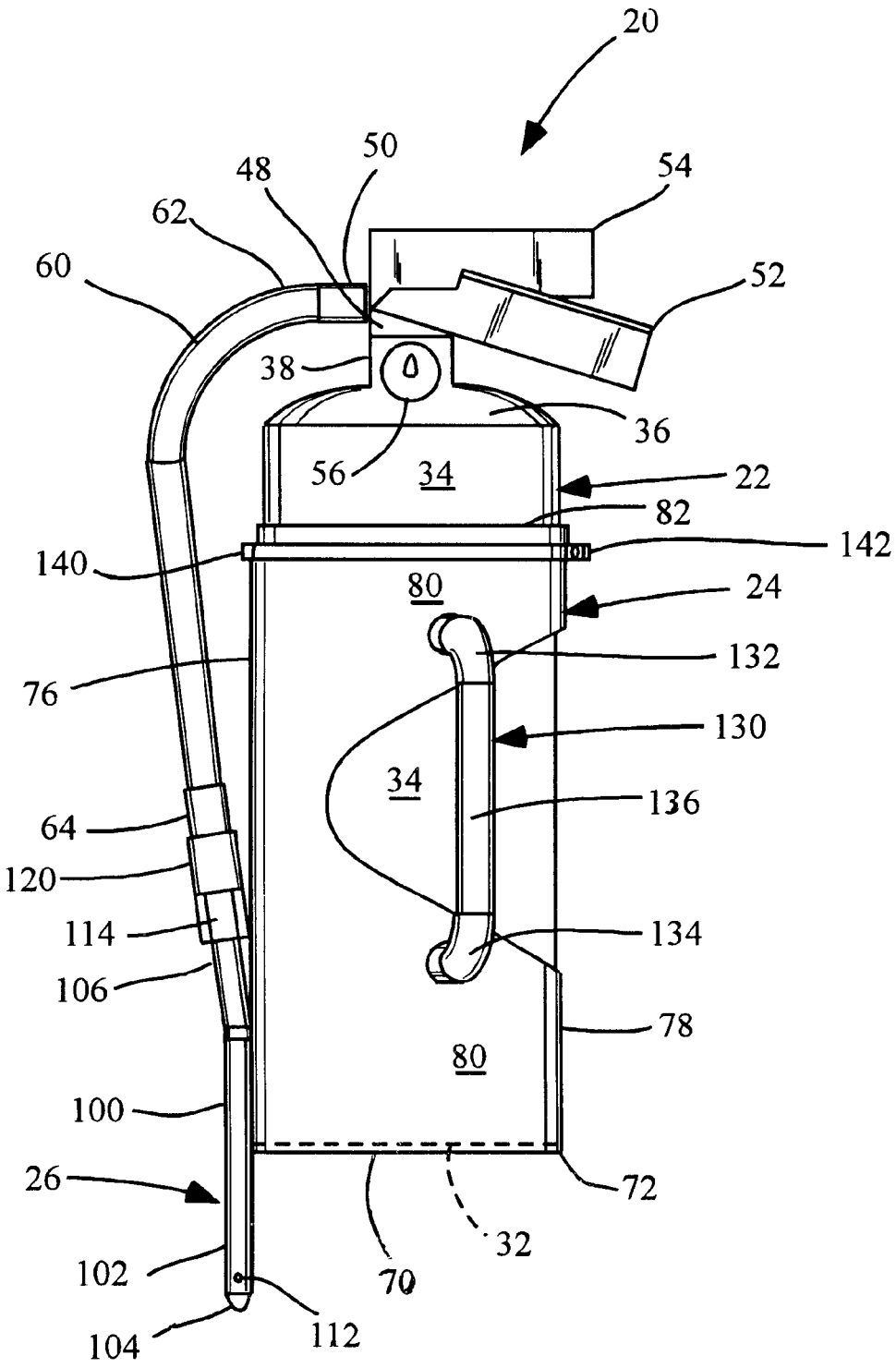
FIG. 3 is a side elevation of the fire extinguishing apparatus of FIGS. 1 and 2 at the scale of FIG. 1 but looking at the apparatus from a position at the right of FIG. 1 or the left of FIG. 2.
Figure 4:
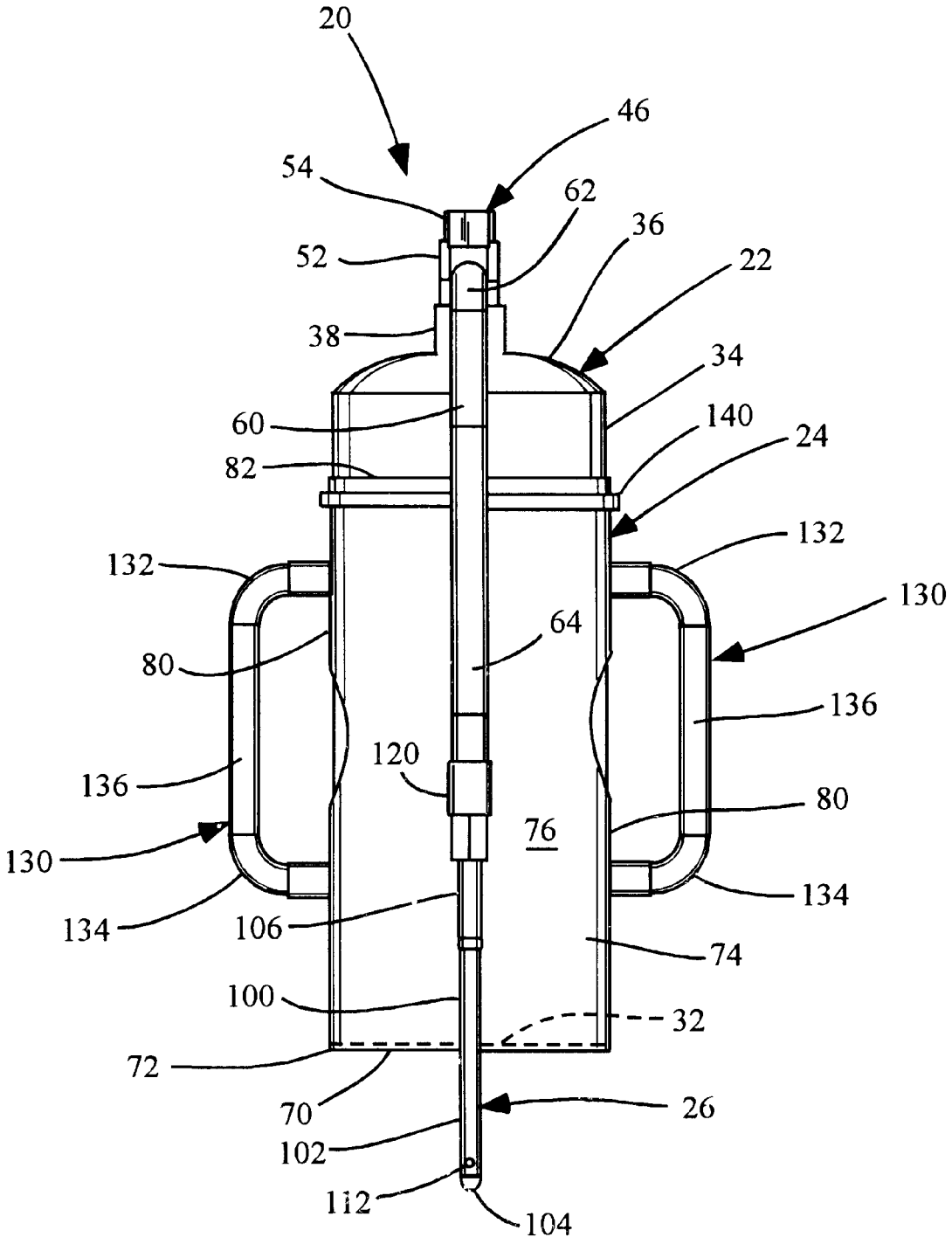
FIG. 4 is a side elevation of the fire extinguishing apparatus of FIGS. 1–3 looking at the apparatus from a position at the left of FIG. 3.

Bracket-shaped handles 130 (FIGS. 1, 2, 7 and 8) have upper and lower mounting segments 132 and 134 rigidly secured, as by welding, to the opposite side surfaces 80 of the upper and lower sections 92 and 94, respectively, of the jacket 24. The handles also include intermediate holding segments that join their respective upper and lower mounting segments and bridge the space resulting from the cutaway 90. As best shown in FIGS. 2, 5 and 6, the handles thus project outwardly from the opposite side surfaces of the jacket and slightly rearwardly therefrom. In the embodiment of the jacket 24 used with the Ansel type of fire extinguisher 22, the weight of the jacket, the pads 97 and 98, the nozzle 26, and the handles 130 is approximately 5 to 8 pounds. Again, this particular weight is not a limitation on the invention.

The fire extinguisher 22 and the jacket 24 are assembled to provide the fire extinguishing apparatus 20, as shown in FIGS. 1–5. An adjustable band 140 is fitted around the upper section 92 of the jacket 24, and a threaded fastener 142 interconnects opposite ends of the bands; alternatively, an over-center buckle may be used to provide for rapid assembly or disassembly of the extinguisher and the jacket. As such, the fire extinguisher is slidably fitted within the side wall 74 of the jacket through the upper opening 84 with the hose 60 hanging downwardly in front of the jacket. The tank is slid into the jacket until the rim 33 on the bottom wall 32 rests on the bottom insulating pad 98. It is to be noted that the split upper section may be slightly expanded to accommodate insertion of the fire extinguisher tank 30. The coupling 120 is connected so that the hose is in communication with the nozzle 26. After the fire extinguisher is thus properly fitted within the jacket, the fastener 142 is tightened so that the tank is snugly held within the jacket. Thus, the jacket together with the nozzle, handles, and band, as a separate unit, may be considered as a holder or housing for the fire extinguisher, such holder or housing being generally indicated by the number 145.

Figure 10:
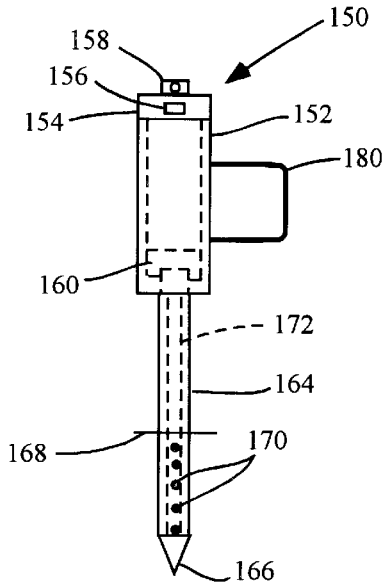
FIG. 10 is a side elevation on a reduced scale of another embodiment of the apparatus of the present invention, showing internal features in dashed lines.
Figure 11:
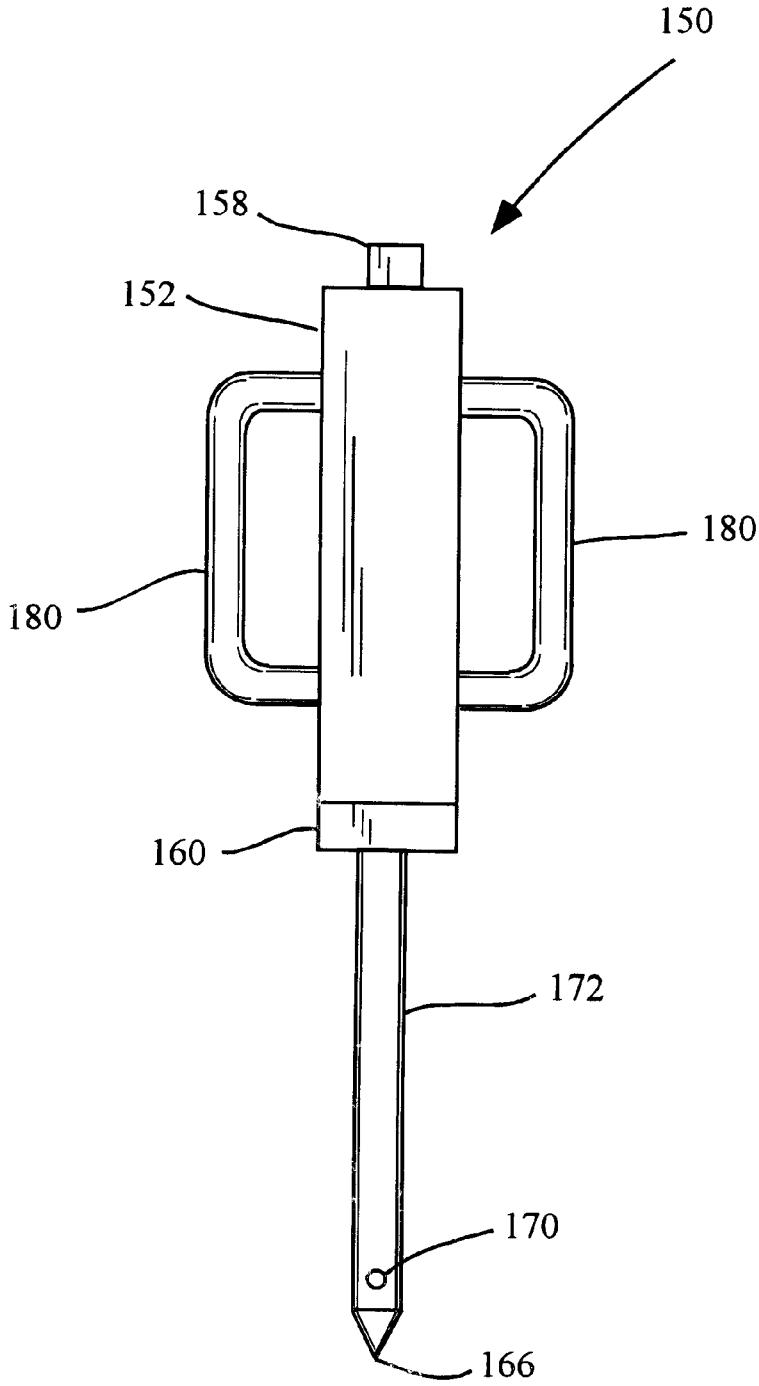
FIG. 11 is an enlarged side elevation of a variation of the embodiment of FIG. 10.

A second embodiment of the subject fire extinguishing apparatus is generally indicated by the number 150 in FIGS. 10 and 11. In this embodiment, both the fire extinguisher and the holder are combined into one self-contained unit. Thus, the second embodiment includes a tank or holder or housing 152, all in one, containing a fire extinguishing agent, as before, and having an upper opening which is closed by a threaded cap 154 to facilitate refilling of the tank. A refill valve 156 is incorporated in the threaded cap, and a protective cap 158 is provided over the refill valve. A force-activated discharge valve 160 is provided in the lower end of the tank adjacent to its bottom wall.

An elongated penetrating nozzle 164 extends axially endwardly from the bottom wall of the tank and terminates in a sharp conical tip 166. A stop plate 168 (FIG. 10 only) projects radially outwardly from the nozzle intermediate the tank and the tip. The nozzle has a plurality of apertures 170 located in the portion of the nozzle between the stop plate and the tip. The nozzle also has a fluid passageway 172 extending longitudinally therethrough and in communication with the tank 152 when the discharge valve 160 is opened. A handle (FIG. 10 only) or handles 180 (FIG. 11 only) projects or project outwardly from the tank.

OPERATION AND METHOD OF USE

The subject fire extinguishing apparatus 20 or 150 may be part of the equipment used by a fire department, may be used by other trained fire-fighting personnel, or especially because of the simplicity of its construction, may even be owned and used by individual laypersons in ways similar to the ways ordinary portable fire extinguishers are used. In the description that follows, reference is made to use by a fire department, but this is by way of example only, it being understood that the invention lends itself to use by many other persons, as suggested above.

If the first embodiment 20 is used, the fire department may choose to maintain the apparatus in the assembled condition shown in FIGS. 1–6, or it may choose to keep the fire extinguisher 22 and the jacket 24 separate since they can be readily assembled if needed. If separate, the conventional fire extinguisher is available as always for use on small fires other than those burning in inaccessible areas such as under the hood of a vehicle. Of course, even if assembled, the fire extinguisher is available for such other uses, but then the extra weight of the holder 145 may not be desired. If the second embodiment 150 of the apparatus is used, it will of course already be fully assembled since it is a self-contained unit not intended for disassembly. In describing the method of using the apparatus, it will be assumed that the first embodiment is to be employed and that the tank 30 is kept separate from the jacket 24 when these two elements are not in use.

With particular reference to FIG. 12. an automobile 200 is shown to illustrate the existence of a fire 202 burning in the engine 204 under the hood 206 of the vehicle. When the fire department receives the alarm that a vehicle is on fire, the firemen jump onto a fire truck and race to the scene. As the fire truck is traveling toward the burning vehicle, the fire extinguisher 22 is quickly assembled with the holder 145 in the manner described above, assuming their storage in disassembled condition. Thus, upon reaching the vehicle, the fire extinguishing apparatus 20 is in the condition shown in FIGS. 1–6 and read), to use.

At the scene of the fire, the fireman grasps the handles 140 and carries the apparatus to the burning automobile 200. Standing next to the hood 206, the fireman lifts the apparatus over his head with the nozzle 26 pointed downwardly toward the hood. The fireman then thrusts the apparatus rapidly downwardly causing the tip 104 of the nozzle to penetrate or punch through the hood and the bottom wall 70 of the jacket 24 lo come to rest against the top of the hood. In this position, the apertures 112 of the nozzle are under the hood in the area of the fire. At that point, the fireman grasps the valve handles 52 and 54 and opens the valve 46. This causes the fire extinguishing agent to be propelled under pressure from the tank 30, through the hose 60, into the penetrating nozzle 26 and out of the apertures 112, as illustrated in FIG. 12. As such, the fire retardant material is sprayed all over the area underneath the engine causing the material to smother the fire.

If the second embodiment 150 of the subject fire extinguishing apparatus is used, the handle 180 is grasped and the apparatus is swung downwardly causing the nozzle 164 to penetrate the hood of the vehicle, in a manner similar to that with regard to the first embodiment 20. If the FIG. 10 version is used, the stop 168 limits penetration of the nozzle. The impact of the nozzle against the hood causes the discharge valve 60 to open thereby releasing the fire retardant material through the nozzle and out of the apertures and into the area of the fire, in a manner similar to that discussed above with regard to the first embodiment.

Several advantages of the subject fire extinguishing apparatus 20 or 150 are to be noted. First, the apparatus is portable and integrated. either as the assembled extinguisher 22 and holder 145 of the first embodiment or the self-contained unit 150 of the second embodiment. Although the first embodiment needs to be assembled before used, such assembly can be accomplished in a matter of seconds. If not assembled, the conventional fire extinguisher is available for use in the normal manner. Thus, the holder 145 allows a conventional fire extinguisher to be readily adapted for use in extinguishing vehicle fires.

A significant advantage is also realized by combining a conventional fire extinguisher, as 22, with the subject holder 145. That is, a predetermined force is of course necessary to thrust the nozzle 26 through the sheet metal of the vehicle hood 206. The subject invention allows the weight of the conventional fire extinguisher to be used in achieving the mass necessary to cause the nozzle to penetrate the hood. Although the precise weight of the disclosed embodiment is not limiting to the invention, the combined weight of the fire extinguisher and the holder is approximately 15 to 20 pounds. This weight can readily be lifted by the fireman or other firefighting person, raised above his or her head, then thrust downwardly whereupon this extra weight assists in projecting the nozzle through the vehicle hood.

With the assembled apparatus 20 or the self-contained apparatus 150, the fire extinguishing method is carried out in one step. That is, with prior methods, either a hole for inserting a nozzle first had to be chopped in the hood with an ax before the nozzle could be inserted or, alternatively, a nozzle with a penetrating point first had to be thrust into the hood and thereafter connected to a source of fire extinguishing material. In the present invention, the tank and the nozzle are combined into one unit so that when the nozzle is punched through the hood, it is already connected to the tank and immediately ready to dispense fire retardant, the weight of the tank being used to assist in penetrating the vehicle hood.

Although the invention has been described above and is especially suited for fighting a vehicle fire, it will be understood that it may be used for extinguishing fires behind barriers other than the described vehicle hood, such as in a closed compartment of a vehicle or otherwise or behind a wall or under a floor of a building. In general, use of the subject apparatus in such applications minimizes danger to the firefighter and others and helps to minimize property loss because it saves valuable time in the ever-present task of applying fire retardant on a fire just as quickly as possible.

Although preferred embodiments of the present invention have been shown and described, various modifications, substitutions and equivalents may exist without departing from the spirit and scope of the invention. Accordingly, it is to be understood that the present invention has been described by way of illustration and not limitation.

What is claimed is:

1. A fluent material dispensing apparatus, comprising:

a tank for containing a fluent material to be dispensed having an outlet through which the material can be dispensed;

a valve connected to said outlet and having opened and closed positions;

fluent material stored in the tank when the valve is in closed position and releasable from the tank when the valve is in opened position;

a nozzle having an elongated penetrating end portion extending from the tank in an operative position wherein it is in rigid immovable relationship to the tank, the penetrating end portion having a longitudinal axis, the nozzle also having a fluid-conducting passageway having an outlet opening through the penetrating end portion and an inlet connected to the valve; and handle means projecting laterally outwardly of the apparatus transversely of said axis.

2. The apparatus of claim 1, wherein the handle means includes handles attached to and projecting outwardly from the tank transversely of said axis.

3. The apparatus of claim 1, wherein the apparatus is portable;

wherein the tank has an end wall with a transverse dimension;

wherein the fluent material is stored under pressure in the tank when the valve is closed; and wherein the penetrating end has a diameter less than the transverse dimension of the end wall of the tank.

4. The apparatus of claim 1, wherein the tank is elongated and has a length extending lengthwise of said axis; and wherein the penetrating end portion has a length shorter than the length of the tank.

5. The apparatus of claim 1, wherein the penetrating end portion terminates in a tip; and wherein there is a stop extending transversely of the penetrating end portion and spaced axially thereof from the tip.

6. A jacket for a dispensing apparatus that includes a container of material to be dispensed, comprising:

an elongated rigid housing having a bottom wall, a side wall extending from the bottom wall in circumscribing relation to a longitudinal axis of the housing, opposite ends, and an opening adapted to receive a container of material to-be-dispensed, the housing being of a size large enough to receive substantially all of the container therein;

an elongated rigid nozzle projecting endwardly from the bottom wall to a sharp penetrating tip and being mounted on the housing against axial movement relative thereto, the nozzle having a longitudinal passageway providing an outlet adjacent to the tip and an inlet intermediate the ends of the housing; and a handle projecting rigidly from the housing.

7. The jacket of claim 6, wherein there are handles rigidly projecting from opposite sides of the side wall.

8. The jacket of claim 6, wherein there are handles rigidly connected to and extending outwardly on opposite sides of the housing.

9. A fire extinguishing apparatus, comprising:

a holder;

a fire extinguisher in the holder;

a rigid nozzle extending from the holder in an operative position in which it is in rigid relationship with the holder, the nozzle extending from the holder to a penetrating end providing an outlet opening, the nozzle in said operative position being rigid throughout its length from the holder to the penetrating end; and handle means rigidly projecting from the holder.

10. The apparatus of claim 9, wherein the fire extinguisher is releasable from the holder and useable as a fire extinguisher independently of the holder.

11. The apparatus of claim 9, wherein the fire extinguisher integrated with and not releasable from the holder.

12. The apparatus of claim 11, wherein the holder is a cylindrical tank;

wherein the nozzle projects axially downwardly from the tank in said operative position; and wherein the nozzle is in both transversely and axially rigid relationship to the housing in said operative position.

13. The apparatus of claim 9, wherein there are a pair of handles on opposite sides of the holder.

14. The apparatus of claim 9, wherein there is a valve on the tank connected to the nozzle and establishing fluid communication between the tank and the nozzle when the valve is open.

15. The apparatus of claim 9, wherein the tank and the holder are releasably fitted together and held against relative movement therebetween; and wherein the nozzle extends rigidly from the holder endwardly of the tank.

16. The apparatus of claim 9, wherein the fire extinguisher includes a tank; and wherein the nozzle has an inlet opening in fluent communication with the tank.

17. A portable self-contained fire extinguishing apparatus, comprising:

an elongated tank having a bottom;

valving on the tank having open and closed positions;

a fluent fire extinguishing material releasably stored under pressure in the tank when the valving is in closed position;

an elongated rigid nozzle fastened to the tank with the nozzle and the tank immovable relative to each other during use of the apparatus to dispense the fire extinguishing material the nozzle providing a penetrating end portion extending endwardly of the tank from the bottom thereof and an outlet opening in the penetrating end portion, the valving interconnecting the tank and the nozzle, the tank with its stored fire extinguishing material, the nozzle, the valving, and the handles together constituting said portable self-contained fire extinguishing apparatus that dispenses said fluent fire extinguishing material when the valving is in open position without the need to connect the apparatus to another source of fluent fire extinguishing material under pressure; and handles securely fastened to and projecting outwardly from the tank in spaced relation therearound.

18. The apparatus of claim 17, wherein there is a jacket securely fitted around the tank; and wherein the nozzle is rigidly secured to the jacket and projects endwardly from the bottom of the tank.

19. The apparatus of claim 18, wherein the tank is releasably slidably fitted into and attached to the jacket.

20. The apparatus of claim 18, wherein there are a pair of handles laterally projecting from the jacket.

21. The apparatus of claim 17, wherein the bottom of the tank has a peripheral edge, and wherein the nozzle projects endwardly of the tank from said peripheral edge.

22. The apparatus of claim 17, wherein the bottom of the tank includes a bottom wall;

wherein there is a jacket securely fitted around the tank, the jacket having a bottom wall having a peripheral edge;

wherein the bottom wall of the tank rests on the bottom wall of the jacket;

wherein the nozzle is rigidly secured to the jacket on one side thereof and projects endwardly from the bottom wall of the jacket at the peripheral edge thereof.

23. The apparatus of claim 22, wherein there are handles projecting from the jacket on the opposite sides thereof.

24. The apparatus of claim 17, wherein the apparatus weighs from about 15 pounds to about 20 pounds.

25. A fire extinguishing apparatus, comprising:

an elongated tank adapted to contain a fire extinguishing material and having a bottom;

a valve on the tank having an open position in which it releases fire extinguishing material from the tank;

a jacket fitted around and fastened to the tank;

an elongated rigid nozzle securely fastened to the jacket against movement relative to the jacket axially thereof, and providing a penetrating end portion extending endwardly from the bottom of the tank, a fluid-conducting passageway having an outlet opening through the penetrating end portion, and an inlet connected to the valve; and handles on the jacket.

26. An apparatus for extinguishing a fire behind a wall, comprising:

a rigid metal jacket having a bottom wall, a side wall extending upwardly from the bottom wall along the generatrix of a cylinder, and a top;

an elongated rigid nozzle securely fastened to the jacket in axially rigid relationship thereto and providing penetrating end portion with a sharp tip extending endwardly from the bottom wall of the jacket, a lower fluid-conducting passageway having an outlet opening through the penetrating end portion, and an upper inlet;

an elongated fire extinguishing tank having a bottom and a top and releasably fitted in the jacket with the bottom wall of the tank against the bottom wall of the jacket, the tank adapted to contain fire extinguishing material under pressure;

a fastener releasably fastening the jacket around the tank;

a valve on the top of the tank having a closed position for confining the fire extinguishing material in the tank and an open position for releasing the fire extinguishing material from the tank;

a hose interconnecting the valve and the inlet of the nozzle; and handles projecting outwardly from opposite sides of the jacket.

27. A method of a extinguishing a fire on the opposite side of a wall from where a firefighter is located, the wall facing generally upwardly wherein the firefighter uses a fire extinguishing apparatus including a tank containing a fire-extinguishing material and having an outlet; a valve having an open position in which it allows release of the fire-extinguishing material from the tank; a nozzle firmly attached to the tank with the nozzle and the tank being immovable relative to each other during performance of the method, the nozzle providing a wall-penetrating end, a fluid-conducting passageway having an outlet opening through the wall-penetrating end, and an inlet connected to the valve, comprising the steps of:

lifting the apparatus, including both the tank and the nozzle, into a spaced relation to the wall on the opposite side thereof from the burning fire and with the wall-penetrating end of the nozzle pointed toward the wall and above the place in the wall where the wall-penetrating end the nozzle is to penetrate the wall, causing the apparatus, including both the tank and the nozzle, to move downwardly toward the wall and thus causing the wall-penetrating end of the nozzle to penetrate said place in the wall until the outlet of the nozzle is on the opposite side of the wall from the firefighter, and causing the valve to open when the outlet of the nozzle is on said opposite side of the wall.

28. The method of claim 27, wherein the wall is generally horizontal and below the firefighter's arms;

wherein the lifting step involves raising the apparatus above the wall with the nozzle pointing generally downwardly; and wherein the causing step involves causing the apparatus to move downwardly from the raised position to bring the wall-penetrating end of the nozzle into engagement with the wall and to cause the wall penetrating end to punch through the wall.

29. The method of claim 28, wherein the apparatus has handles projecting laterally from the tank and transversely of the movement of the apparatus during the thrusting step;

wherein the lifting step involves grasping the handles; and wherein the lifting and causing steps are carried out while grasping the handles.

30. The method of claim 27, wherein the apparatus lifting and apparatus causing steps are carried out by only a single firefighter.

31. A jacket adapted to receive a container of material to be dispensed from the container, the container having maximum longitudinal and transverse dimensions, comprising:

an elongated rigid housing having a bottom wall, a side wall extending from the bottom wall in circumscribing relation to a longitudinal axis of the housing, and an opening adapted to receive such a container, the housing having a maximum longitudinal dimension measured from the bottom wall to the opening sufficient to extend over a substantial portion of said maximum longitudinal dimension and a maximum transverse dimension within the side wall sufficient to circumscribe said maximum transverse dimension of the container; and an elongated rigid nozzle secured to the side wall of the housing in an operative position wherein it is maintained against both axial and transverse movement relative to the housing and having opposite inlet and outlet ends respectively above and below the bottom wall, the outlet end terminating in a penetrating tip.

32. A fire extinguishing apparatus, comprising:

a tank adapted to contain a fire extinguishing material and having a tank outlet and a bottom;

a valve connected to the tank outlet and having an open position in which it releases fire extinguishing material from the tank outlet;

a jacket fitted around the tank and retaining it therein;

a rigid nozzle mounted on the jacket in an operative position wherein it is maintained in a rigid relationship thereto having an inlet connected to the valve and a penetrating end portion extending endwardly from the bottom of the tank and having a nozzle outlet therein; and handles on the jacket.

33. A method of extinguishing a fire in an automobile engine, the automobile having a hood over the engine, wherein the firefighter uses a portable fire extinguishing apparatus including a tank containing a pressurized fire-extinguishing material and having an outlet; a valve having an open position in which it allows release of the fire-extinguishing material from the tank; a nozzle attached to the tank with the nozzle and the tank being immovable relative to each other during the performance of the method, the nozzle providing a wall-penetrating end, a fluid-conducting passageway having an outlet opening through the wall-penetrating end, and an inlet connected to the valve; and handle means projecting from the apparatus, comprising the steps of:

grasping the handle means and lifting the apparatus including both the tank and the nozzle above the automobile hood with the wall-penetrating end of the nozzle pointed downwardly toward and in spaced relation to the hood and thus on the opposite side thereof from the burning fire, and manually moving the apparatus including both the tank and the nozzle downwardly and thus the wall-penetrating end of the nozzle downwardly toward the hood and into contact with and through the hood, until the outlet of the nozzle is on the opposite side of the hood from the firefighter, whereby fire extinguishing material is applied to the fire upon opening the valve.

34. The method of claim 33, wherein the handle means are a pair of handles projecting outwardly from and in spaced relation around the apparatus transversely of the path of movement of the apparatus as it is lifted and caused to move downwardly relative to the automobile hood; and wherein the grasping and moving steps involves the user grasping the handles individually in the user's hands.

35. The method of claim 33, wherein the handle means projects outwardly from the tank, and wherein the lifting and causing steps are carried out by a firefighter holding the handle means, the weight of the tank and its contents assisting the firefighter in forcing the wall-penetrating end the nozzle through the hood.

36. A fluent material dispensing apparatus, comprising:

a tank for containing a fluent material to be dispensed having an outlet through which the material can be dispensed; and a nozzle attached to the tank in rigid immovable relationship to the tank and extending therefrom to a penetrating end, a fluid-conducting passageway having an outlet opening through the penetrating end, and an inlet connected to the outlet of the tank, wherein the tank is elongated and has a longitudinal axis;

wherein the tank has a bottom wall;

wherein the nozzle has a diameter less than the diameter of the bottom wall and extending therefrom in substantially parallel relation to the axis of the tank; and wherein there are handles rigidly connected to opposite sides of the tank and extending outwardly therefrom transversely of the axis of the tank.

* * * * *